US007793808B1

(12) United States Patent
Herman et al.

(10) Patent No.: US 7,793,808 B1
(45) Date of Patent: Sep. 14, 2010

(54) STACKABLE GARMENT HANGER

(76) Inventors: Richard L. Herman, 419 Red Coat Ct., Waterford, WI (US) 53185; Gordon H. Smith, 5635 Charles St., Racine, WI (US) 53402

( * ) Notice: Subject to any disclaimer, the term of this patent is extended or adjusted under 35 U.S.C. 154(b) by 0 days.

(21) Appl. No.: 12/485,972

(22) Filed: Jun. 17, 2009

(51) Int. Cl.
*A41D 27/22* (2006.01)

(52) U.S. Cl. ..... 223/88

(58) Field of Classification Search ..... 223/85, 223/88, 92, 95; 211/85.3
See application file for complete search history.

(56) References Cited

U.S. PATENT DOCUMENTS

| | | | | |
|---|---|---|---|---|
| 2,391,661 | A | 1/1945 | Watkins et al. | |
| 2,498,400 | A | 2/1950 | Du Lude | |
| 4,058,222 | A * | 11/1977 | Singer | 223/92 |
| 4,653,678 | A | 3/1987 | Blanchard et al. | |
| 5,074,445 | A | 12/1991 | Chen | |
| 5,603,438 | A * | 2/1997 | Jugan | 223/85 |
| 7,182,232 | B2 * | 2/2007 | Fleming et al. | 223/88 |
| 2006/0278671 | A1 * | 12/2006 | Gouldson | 223/85 |
| 2007/0158375 | A1 * | 7/2007 | Yau | 223/85 |
| 2007/0199964 | A1 * | 8/2007 | Gouldson | 223/91 |
| 2007/0199965 | A1 * | 8/2007 | Gouldson | 223/91 |

FOREIGN PATENT DOCUMENTS

GB 2350058 A * 11/2000

* cited by examiner

*Primary Examiner*—Gary L Welch
*Assistant Examiner*—Nathan E Durham
(74) *Attorney, Agent, or Firm*—Donald J. Ersler

(57) ABSTRACT

A stackable garment hanger includes a pole hook and a plurality of hanger members. The pole hook includes a pole hook member and a hanger retaining member. Each hanger member includes a garment retaining member, the hanger retaining member, a finger tab and a retaining rod. The hanger retaining member receives the retaining rod. The hanger retaining member extends from a top of the garment retaining member. One end of an extension member extends from a top of the hanger retaining member and the retaining rod extends from the other end of the extension member. The finger tab extends from the extension member. In use, the pole hook is placed on a hanger pole. A first hanger member is inserted into the hanger retaining member of the pole hook. Successive hanger members are attached to each adjacent hanger member.

15 Claims, 5 Drawing Sheets

STACKABLE GARMENT HANGER

BACKGROUND OF THE INVENTION

1. Field of the Invention

The present invention relates generally to garment hangers and more specifically to a stackable garment hanger, which allows a plurality of hangers to be hung upon themselves.

2. Discussion of the Prior Art

U.S. Pat. No. 2,391,661 to Watkins et al. discloses a clothes hanger. The Watkins et al. patent includes separate clothes hangers arranged in a battery to conserve closet space. U.S. Pat. No. 2,498,400 to DuLude discloses a support for garment hangers. The DuLude patent includes a hanger device to be mounted on a first garment hanger and including a hook portion for supporting a second garment hanger. U.S. Pat. No. 4,653,678 to Blanchard et al. discloses a ganging hook for garment hangers. The Blanchard et al. patent includes a hanger having an integral hook anchor for an auxiliary hanger depending from the body of the hanger below and in vertical alignment with the hanger's support hook.

U.S. Pat. No. 5,074,445 to Chen discloses a garment hanger with swivel hook and ganging hook. The Chen patent includes a garment hanger with a hook member coupled with a garment supporting frame by a pivot joint. The hook member can be rotated within a fixed degree of angle relative to the garment supporting frame to that the garment hanger can be conveniently hung on a clothes-line for holding a garment to keep it in shape.

Accordingly, there is a clearly felt need in the art for a stackable garment hanger, which allows a plurality of hangers to be hung upon themselves in a vertical orientation.

SUMMARY OF THE INVENTION

The present invention provides a stackable garment hanger, which allows a plurality of hangers to be hung upon themselves. The stackable garment hanger includes a pole hook and a plurality of hanger members. The pole hook includes a pole hook member and a hanger retaining member. Each hanger member includes a garment retaining member, the hanger retaining member, a finger tab and a retaining rod. The pole hook member includes a hook portion and a retaining portion extending from a bottom of the hook portion. The hanger retaining member extends from a bottom of the retaining portion. The hanger retaining member includes a pair of upright hooks that are separated by a finger space. The upright hooks are sized to receive the retaining rod.

The garment retaining member preferably has the shape of a triangular loop, similar to a normal garment hanger. The hanger retaining member extends from a top of the garment retaining member. One end of an extension member extends from a top of the hanger retaining member and the retaining rod extends from the other end of the extension member. The finger tab extends from substantially the other end of the extension member. In use, the pole hook is placed on a hanger pole in a closet or the like. A garment is placed on a first hanger member. The finger tab of the first hanger member is grasped with a forefinger and a thumb, and the retaining rod is placed in the hanger retaining member of the pole hook. The process is repeated with a second hanger member by placing a second retaining rod of the second hanger member into the hanger retaining member of the first hanger member.

Accordingly, it is an object of the present invention to provide a stackable garment hanger, which allows a plurality of hangers to be hung upon themselves in a vertical orientation.

These and additional objects, advantages, features and benefits of the present invention will become apparent from the following specification.

DETAILED DESCRIPTION OF THE PREFERRED EMBODIMENTS

Figure 1:
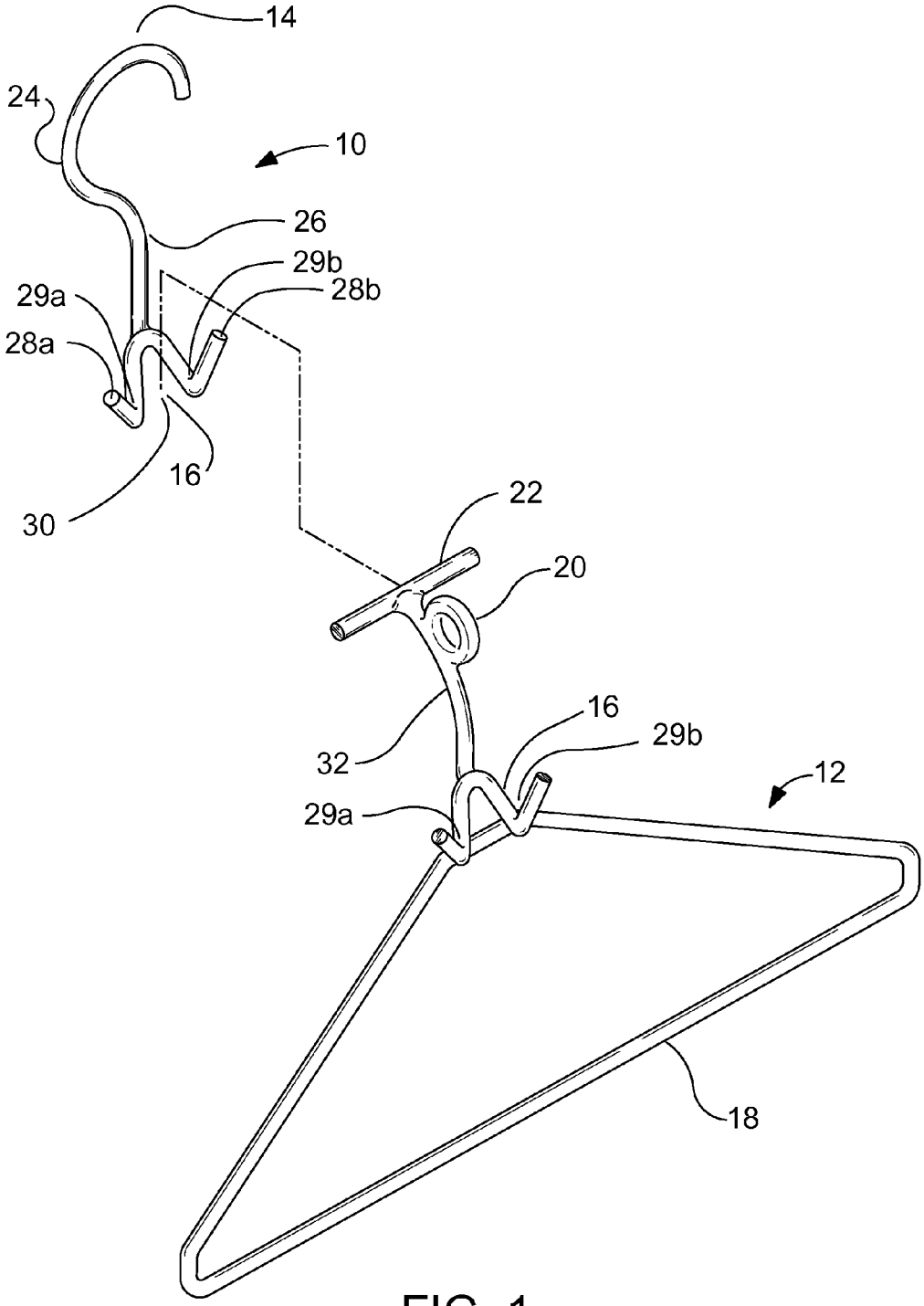
FIG. 1 is an exploded perspective view of a pole hook and one hanger member of a stackable garment hanger in accordance with the present invention.
Figure 2:
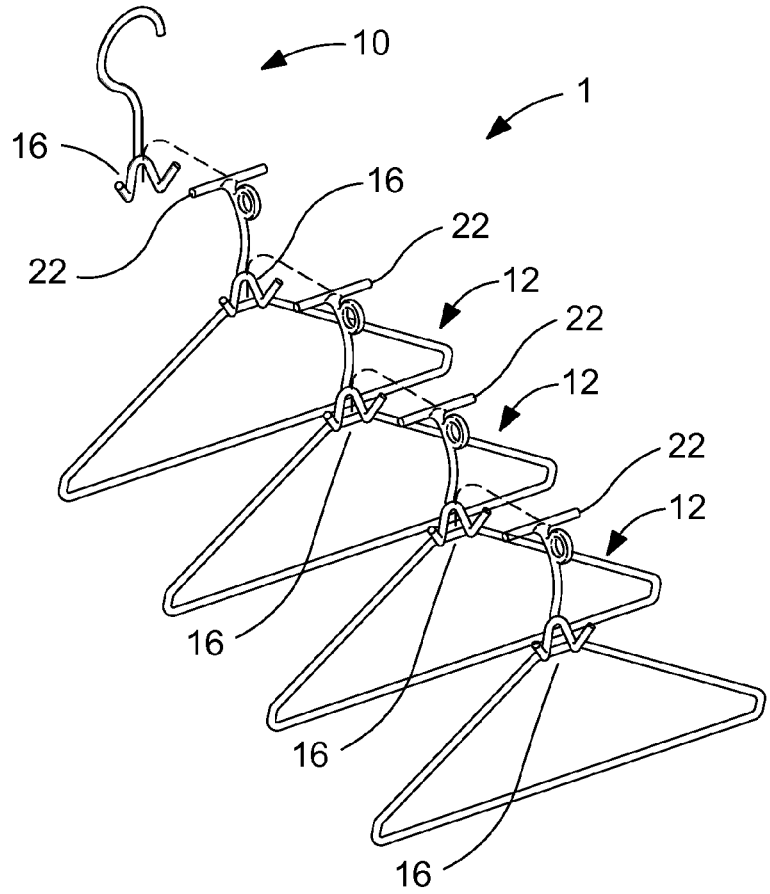
FIG. 2 is an exploded perspective view of a stackable garment hanger in accordance with the present invention.
Figure 3:
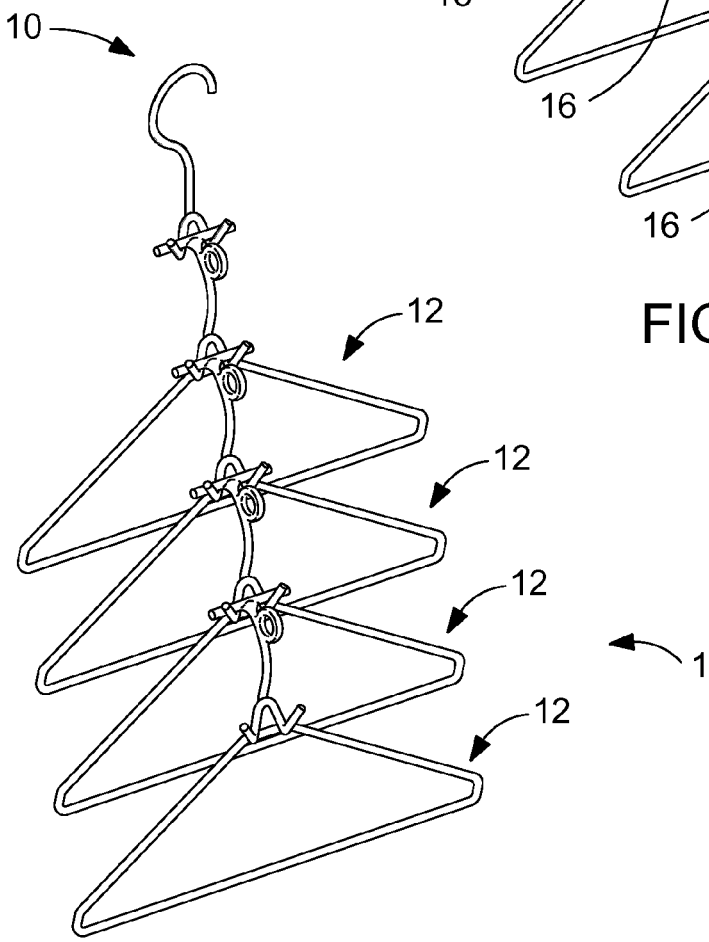
FIG. 3 is a perspective view of a stackable garment hanger in accordance with the present invention.
Figure 6:
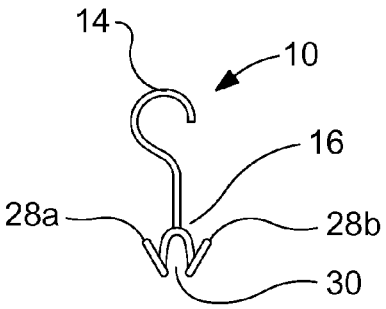
FIG. 6 is a front view of a pole hook of a stackable garment hanger in accordance with the present invention.
Figure 7:
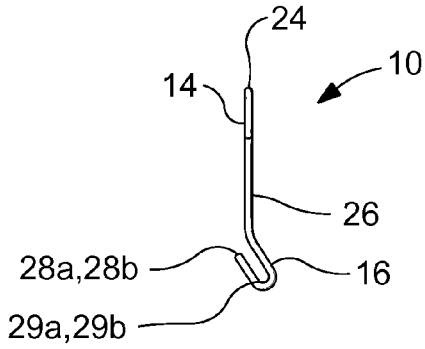
FIG. 7 is a side view of a pole hook of a stackable garment hanger in accordance with the present invention.
Figure 8:
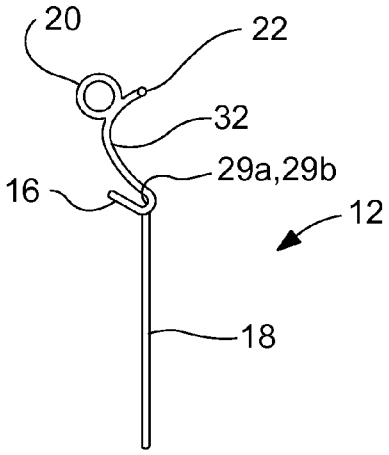
FIG. 8 is a side view of a hanger member of stackable garment hanger in accordance with the present invention.
Figure 9:
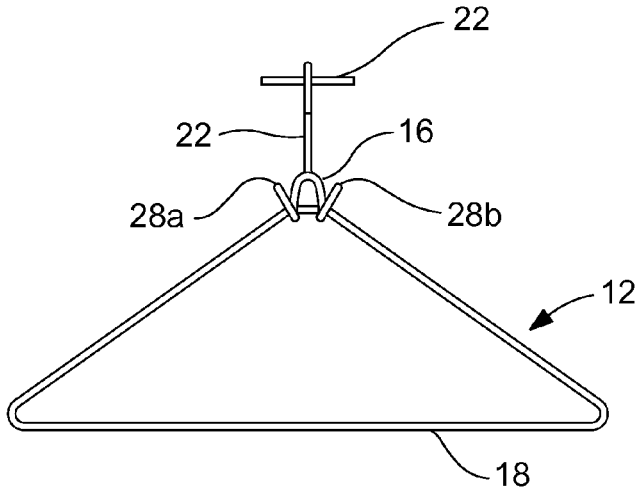
FIG. 9 is a front view of a hanger member of stackable garment hanger in accordance with the present invention.
Figure 10:
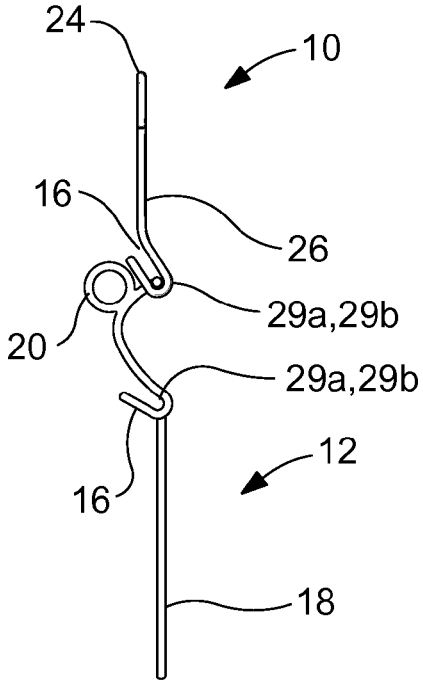
FIG. 10 is a side view of a hanger member retained by a pole hook of a stackable garment hanger in accordance with the present invention.
Figure 11:
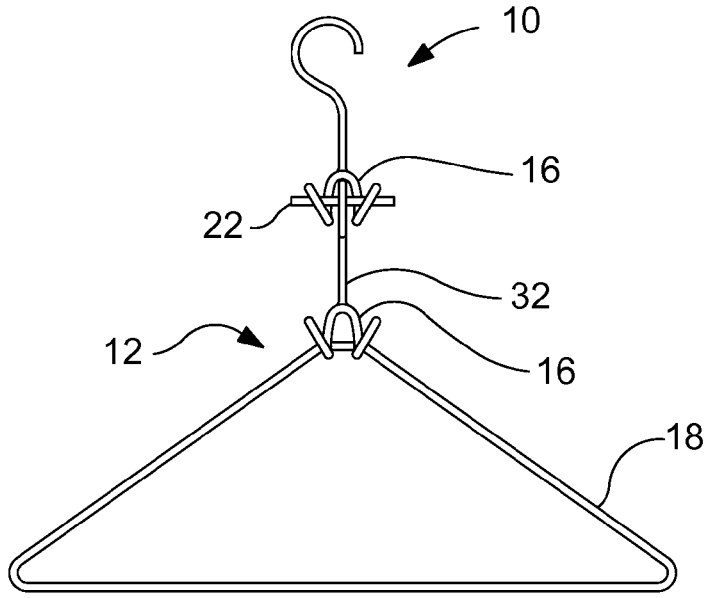
FIG. 11 is a front view of a hanger member retained by a pole hook of a stackable garment hanger in accordance with the present invention.

With reference now to the drawings, and particularly to FIG. 1, there is shown an exploded perspective view of a pole hook 10 and one hanger member 12 of a stackable garment hanger 1. With reference to FIGS. 2-3, the stackable garment hanger 1 includes the pole hook 10 and a plurality of hanger members 12. With reference to FIGS. 6-7, the pole hook 10 includes a pole hook member 14 and a hanger retaining member 16. With reference to FIGS. 8-11, each hanger member 12 includes the hanger retaining member 16, a garment retaining member 18, a finger tab 20 and a retaining rod 22. The pole hook member 14 includes a hook portion 24 and a retaining portion 26. The retaining portion extends from a bottom of the hook portion 24. The hanger retaining member 16 extends from a bottom of the retaining portion 26. The hanger retaining member 16 includes a pair of upright hooks 28*a* and 28*b*, which are separated by a finger space 30. A bottom receiver 29*a*, 29*b* is formed at a bottom of the upright hooks 28*a*, 28*b* and are sized to receive the retaining rod 22. The retaining rod 22 is seated in the bottom receiver 29*a*, 29*b* prevents the garment member 12 from twisting relative to the pole hook 10 or another garment member 12, because of the self-centering design thereof.

The garment retaining member 18 preferably has the shape of a triangular loop, similar to a normal garment hanger. The hanger retaining member 16 extends from a top of the garment retaining member 18. One end of an extension member 32 extends from a top of the hanger retaining member 16 and the retaining rod 22 extends from the other end of the extension member 32. The extension member 32 preferably has an outwardly curving profile to provide clearance for a shirt collar 104*a* of a shirt 102*a*. The finger space 30 provides clearance for insertion of the extension member 32 between the upright hooks 28*a*, 28*b*. The finger tab 20 extends from substantially the other end of the extension member 32. The finger tab 20 makes it possible to manipulate a garment on a hanger member 12 without touching the garment. The pole hook 10 and the plurality of hanger members 12 are each preferably fabricated by plastic injection molding or any other suitable manufacturing process.

Figure 4:
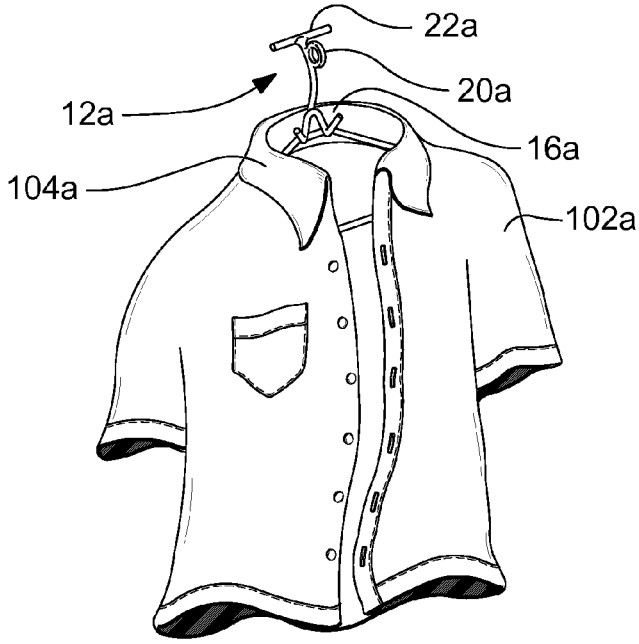
FIG. 4 is a perspective view of a garment retained on a hanger member of a stackable garment hanger in accordance with the present invention.
Figure 5:
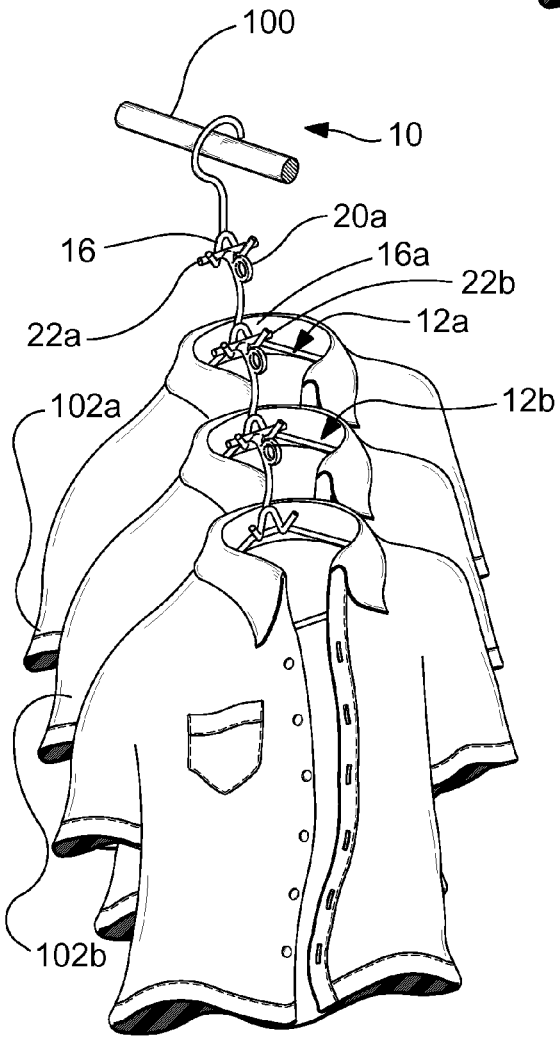
FIG. 5 is a perspective view of a stackable garment hanger with a plurality garments retained thereupon and retained on a hanger pole in accordance with the present invention.
Figure 5A:
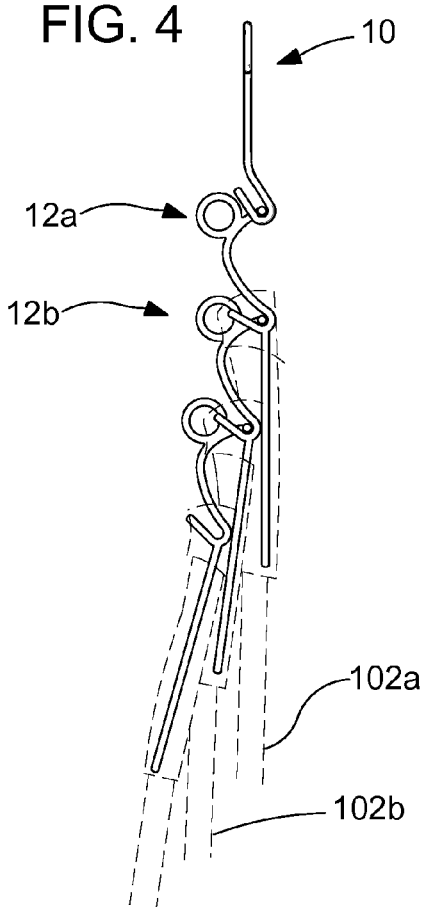
FIG. 5*a* is a side view of a stackable garment hanger with a plurality garments retained thereupon in accordance with the present invention.

With reference to FIGS. 4-5, the pole hook 10 is placed on a hanger pole 100 in a closet or the like. A garment 102*a* is placed on a first hanger member 12*a*. The finger tab 20*a* of the first hanger member is grasped with a forefinger and a thumb and the retaining rod 22 is placed in the hanger retaining member 16 of the pole hook 10. The process is repeated with a second hanger member 12*b* (and successive hanger members) by placing a second retaining rod 22*b* of the second hanger member 12*b* into the hanger retaining member of the first hanger member 16*a*.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A stackable garment hanger comprising:

a pole hook including a pole hook member and a first hanger retaining member extending from said pole hook member, said first hanger retaining member includes a first pair of spaced apart upright hooks, said first pair of spaced apart upright hooks include a pair of first bottom receivers formed on a bottom of said thereof; and at least one hanger member, each one of said at least one hanger member including a garment retaining member, a second hanger retaining member, an extension member and a retaining rod, said second hanger retaining member extending from a top of said garment retaining member, one end of said extension member extending upward from said second hanger retaining member, said retaining rod extending from the other end of said extension member, said retaining rod having a substantially horizontal orientation, said first pair of bottom receivers being sized to receive said retaining rod, said second hanger retaining member being sized to receive said retaining rod.

2. The stackable garment hanger of claim 1 wherein:

said first pair of upright hooks are separated by a finger space.

3. The stackable garment hanger of claim 1 wherein:

said garment retaining member having a substantially triangular shape for retaining a garment.

4. The stackable garment hanger of claim 1, further comprising:

said hook pole member including a hook portion and a retaining portion extending downward from said hook portion, said hanger retaining member extending from said retaining portion.

5. The stackable garment hanger of claim 1 wherein:

at least one successive hanger member of said at least one hanger member being retained on an adjacent hanger member.

6. A stackable garment hanger comprising:

a pole hook including a pole hook member and a first hanger retaining member extending from said pole hook member;

at least one hanger member, each one of said at least one hanger member including a garment retaining member, a second hanger retaining member, an extension member and a retaining rod, said second hanger retaining member extending from said garment retaining member, one end of said extension member extending upward from said second hanger retaining member, said retaining rod extending from the other end of said extension member, said extension member extending from substantially a middle of said retaining rod, said extension member having a substantially curving shape, said extension member providing clearance for a shirt collar, said first and second hanger retaining members being sized to receive said retaining rod.

7. The stackable garment hanger of claim 6 wherein:

said first pair of upright hooks are separated by a finger space.

8. The stackable garment hanger of claim 6 wherein:

said garment retaining member having a substantially triangular shape for retaining a garment.

9. The stackable garment hanger of claim 6, further comprising:

said hook pole member including a hook portion and a retaining portion extending downward from said hook portion, said hanger retaining member extending from said retaining portion.

10. The stackable garment hanger of claim 6 wherein:

at least one successive hanger member of said at least one hanger member being retained on an adjacent hanger member.

11. A stackable garment hanger comprising:

a pole hook including a pole hook member and a first hanger retaining member extending from said pole hook member;

at least one hanger member, each one of said at least one hanger member including a garment retaining member, a second hanger retaining member, an extension member and a retaining rod, said second hanger retaining member extending from said garment retaining member, one end of said extension member extending upward from said second hanger retaining member, said retaining rod extending from the other end of said extension member, said extension member extending from substantially a middle of said retaining rod, said extension member having a substantially curving shape, said first and second hanger retaining members being sized to receive said retaining rod; and a finger tab extending from said extension member to be grasped.

12. The stackable garment hanger of claim 11 wherein:

said first pair of upright hooks are separated by a finger space.

13. The stackable garment hanger of claim 11 wherein:

said garment retaining member having a substantially triangular shape for retaining a garment.

14. The stackable garment hanger of claim 11, further comprising:

said hook pole member including a hook portion and a retaining portion extending downward from said hook portion, said hanger retaining member extending from said retaining portion.

15. The stackable garment hanger of claim 11 wherein:

at least one successive hanger member of said at least one hanger member being retained on an adjacent hanger member.

* * * * *